US011364177B2

(12) United States Patent
Enghard et al.

(10) Patent No.: US 11,364,177 B2
(45) Date of Patent: Jun. 21, 2022

(54) PRESSURE EQUALIZER FOR BABY BOTTLE AND BABY BOTTLE ASSEMBLY

(71) Applicants: Florian Enghard, Frankfurt am Main (DE); Armin Enghard, Frankfurt am Main (DE); Thomas Busch, Frankfurt am Main (DE)

(72) Inventors: Florian Enghard, Frankfurt am Main (DE); Armin Enghard, Frankfurt am Main (DE)

( * ) Notice: Subject to any disclaimer, the term of this patent is extended or adjusted under 35 U.S.C. 154(b) by 149 days.

(21) Appl. No.: 16/321,397

(22) PCT Filed: Aug. 3, 2017

(86) PCT No.: PCT/DE2017/000238
§ 371 (c)(1),
(2) Date: Jan. 28, 2019

(87) PCT Pub. No.: WO2018/024272
PCT Pub. Date: Feb. 8, 2018

(65) Prior Publication Data

US 2019/0175452 A1 Jun. 13, 2019

(30) Foreign Application Priority Data

Aug. 3, 2016 (DE) ..... 102016009358.7

(51) Int. Cl.
*A61J 9/04* (2006.01)
*A61J 9/00* (2006.01)
(Continued)

(52) U.S. Cl.
CPC ..... *A61J 9/04* (2013.01); *A61J 9/006* (2013.01); *A61J 9/085* (2013.01); *A61J 11/04* (2013.01);
(Continued)

(58) Field of Classification Search
CPC ..... A45F 3/16; A45F 2200/0583; A45F 2003/166; A47G 19/2266; A47G 19/2272;
(Continued)

(56) References Cited

U.S. PATENT DOCUMENTS 256,060 A * 4/1882 Seagrave ..... F16L 9/22 138/157
2,376,064 A * 5/1945 Knapp ..... B65D 23/0885 215/13.1
(Continued)

FOREIGN PATENT DOCUMENTS

DE 588312 * 11/1933 ..... A61J 9/08
DE 102013017310 A1 1/2015
(Continued)

OTHER PUBLICATIONS

International Search Report dated Jan. 23, 2018.
Written Opinion dated Jan. 23, 2018.

*Primary Examiner* — Gideon R Weinerth
(74) *Attorney, Agent, or Firm* — Ferrells, PLLC; Michael W. Ferrell; Anna L. Kinney

(57) ABSTRACT

The present invention relates to a pressure equaliser (1) comprising:—a hollow element (101) with a cup-shaped section (1011) and a tubular section (1013) that merge seamlessly one into the other, and—a sealing element (103) that comprises a top edge (1031) with a first diameter (D1) and a central part (1033) with a second diameter (D2), wherein the top edge of the cup-shaped section (1011) of the hollow element (101) is inserted into the second inner diameter (D2) of the central part (1033) of the sealing element (103), the pressure equaliser being characterised in that at least the hollow element (101) can be disassembled into at least two hollow element parts (10*a*, 101*b*) along its longitudinal axis. The present invention further relates to a baby bottle assembly comprising: —a bottle-shaped con-
(Continued)

tainer (3), —a pressure equaliser (1) according to the invention, —a screw element (5) and—a nipple (7*a*) or closure cap (7*b*).

12 Claims, 8 Drawing Sheets

(51) Int. Cl.
*A61J 9/08* (2006.01)
*A61J 11/04* (2006.01)
*A47G 19/22* (2006.01)
*A47G 21/18* (2006.01)

(52) U.S. Cl.
CPC ..... *A47G 19/2266* (2013.01); *A47G 19/2272* (2013.01); *A47G 21/18* (2013.01)

(58) Field of Classification Search
CPC ... A47G 21/185; A47G 21/18; A61J 15/0011; A61J 15/0092; A61J 9/00; A61J 9/04; A61J 9/006; A61J 9/085; B62J 99/00; B67D 2210/00131; B67D 1/0004; B65D 47/32
USPC .... 215/388, 229, 309, 11.1, 11.4, 11.5, 11.6; 220/705, 707, 709, 714; 224/148.2; 239/33, 24
See application file for complete search history.

(56) References Cited

U.S. PATENT DOCUMENTS 2,859,891 A * 11/1958 Carkin ..... A61J 9/001 215/11.3
3,061,129 A * 10/1962 Fitzgerald ..... A61J 9/001 215/11.3
3,136,532 A * 6/1964 Rudnick ..... B01F 13/0057 366/130
3,346,133 A * 10/1967 Herdman ..... A61J 11/0005 215/11.1
4,466,547 A * 8/1984 Klittich ..... A61J 9/001 215/11.3
4,533,057 A * 8/1985 Klittich ..... A61J 9/001 215/11.3
5,356,040 A * 10/1994 Reggiani ..... B05B 11/3084 215/6
5,429,254 A * 7/1995 Christine ..... A61J 9/001 215/11.1
8,684,201 B2 * 4/2014 Berkovitch ..... A61J 9/04 215/11.5
10,166,172 B2 * 1/2019 Rhodes ..... A61J 9/04
10,451,200 B2 * 10/2019 Morton ..... F16B 21/06
10,774,964 B2 * 9/2020 Ryan ..... F16L 59/024
10,779,667 B2 * 9/2020 Phan ..... A47G 21/18
2005/0236353 A1 * 10/2005 Hsu ..... A61J 11/002 215/11.5
2008/0302793 A1 * 12/2008 Tirosh ..... A47G 19/2272 220/203.17
2009/0071926 A1 * 3/2009 Berkovitch ..... A61J 9/04 215/11.4
2010/0072162 A1 * 3/2010 Park ..... A61J 9/08 215/11.5
2010/0181277 A1 * 7/2010 Brown ..... A61J 9/04 215/11.5
2011/0000868 A1 1/2011 Brown et al.
2011/0233236 A1 * 9/2011 Brown ..... A47G 19/2266 222/481
2014/0119154 A1 * 5/2014 Kershaw ..... B01F 3/08 366/130
2014/0190922 A1 * 7/2014 Rhodes ..... A61J 11/02 215/11.5
2016/0106628 A1 * 4/2016 Kemper ..... A61J 9/04 215/11.5
2016/0296422 A1 * 10/2016 Brown ..... A61J 11/02
2017/0105581 A1 4/2017 Enghard
2018/0160831 A1 * 6/2018 Yoo ..... A47G 21/18
2018/0352983 A1 * 12/2018 Allen ..... A47G 21/18
2019/0038058 A1 * 2/2019 Abbott-Glazier ..... A47G 21/18
2019/0152642 A1 * 5/2019 Farahani ..... B65D 1/0276
2019/0387907 A1 * 12/2019 Capone ..... B65D 43/0218
2020/0016040 A1 * 1/2020 Sun ..... A61J 9/04
2020/0128986 A1 * 4/2020 Tran ..... A47G 21/18
2020/0146482 A1 * 5/2020 Watkins ..... A47G 21/18
2020/0154918 A1 * 5/2020 Kao ..... A47G 21/18
2020/0163477 A1 * 5/2020 Fung ..... A47G 21/18
2020/0214485 A1 * 7/2020 Ng ..... A47G 21/18
2020/0323374 A1 * 10/2020 Wang ..... A47G 21/18
2020/0359817 A1 * 11/2020 Zhang ..... A47G 21/18
2020/0390257 A1 * 12/2020 Leinbach ..... A47G 21/189
2020/0397168 A1 * 12/2020 Darrin ..... A47G 21/18
2021/0085109 A1 * 3/2021 Chen ..... A47G 21/18
2021/0093111 A1 * 4/2021 Peng ..... A47G 21/18
2021/0093112 A1 * 4/2021 Kimura ..... A47G 21/18

FOREIGN PATENT DOCUMENTS

JP 2014155524 * 8/2014 ..... A47G 21/18
WO 20150006386 A1 1/2015
WO 2016061226 A1 4/2016

* cited by examiner

PRESSURE EQUALIZER FOR BABY BOTTLE AND BABY BOTTLE ASSEMBLY

CLAIM FOR PRIORITY

This application is a national phase application of PCT/DE2017/000238 filed Aug. 3, 2017 which was based on application DE 10 2016 009 358.7 filed Aug. 3, 2016. The priorities of PCT/DE2017/000238 and DE 10 2016 009 358.7 are hereby claimed and their disclosures incorporated herein by reference.

TECHNICAL FIELD

The present invention relates to a pressure equalizer, especially for a baby bottle, that is simple to clean, as well as a baby bottle assembly comprising this pressure equalizer.

BACKGROUND

Drinking bottles for babies or small children are typically assembled from different parts, the bottle being essentially provided as a container for the drinking liquid, along with a nipple, which can be of different sizes, depending on the age of the baby or small child, and a ring connecting the bottle and the nipple. In most systems the ring accommodating the nipple is screwed onto the bottle. Finally, a cap is provided in most cases, which protects the nipple relative to its surroundings. The nipple has a larger opening in its head through which the drinking liquid can be sucked out. In order to facilitate drinking, pressure equalization between the bottle interior and the outside is prescribed, which can be produced, for example, by small slit-like openings on the side of the nipple. Other systems function using deliberate leaks on the screw connection between the nipple and bottle. These systems, however, are not fully protected from leakage, i.e., the drinking liquid not only can leak out through the opening in the nipple, but also via the pressure equalization opening in unfavorable cases.

There is also the possibility of fastening pressure equalization elements to the bottle, when this [method] is used. However, this is not very practicable if the drinking bottle is to be used on the go, because this pressure equalization element must then be transported separately.

Pressure equalizers are known from the prior art. For example, WO 2016/061226 A1 describes a baby bottle having a dual configuration, which includes a bottle container, a valve arrangement and a ring element. The valve arrangement can be arranged having its edge within the bottle container in order to exert a valve function for the bottle during use. The head of this valve arrangement is then adjusted to the opening of the bottle container and extends into the bottle with an elongated end. The ring element in principle represents a closure for the bottle, simultaneously being laid out to fasten the valve arrangement to the bottle container.

WO 2015/006386 A1 also describes a very similar bottle having a dual configuration, which also includes a bottle container, a valve arrangement and a ring element, in which the ring element here is laid out in two configurations, a first configuration in which the ring element closes the bottle container together with the valve arrangement so that the valve arrangement is essentially sealed with the edge of the bottle container, and a second configuration in which the ring element in principle closes the bottle container when the valve element is not divided.

The baby bottle systems just described from the prior art are marketed, for example, as "Dr. Brown baby bottles". The valve arrangements then represent a type of tunnel system so that the "Dr. Brown baby bottle" permits an open system without [any] leaking out of the beverage contents, in which case the best possible air exchange is made possible between the nipple and the interior of the bottle through the special form of the valve arrangement. This arrangement prevents babies and small children who drink from the bottle from swallowing air during drinking so that colic is prevented.

The "Dr. Brown baby bottles" described in the prior art therefore have one of the best anti-colic systems that is known. This is due to an open system that guarantees air exchange in the bottle during drinking. At the same time the open system is configured as a type of tunnel system so that leaking of the beverage liquid from the bottle is prevented.

In addition to the undisputed advantages of the "Dr. Brown baby bottles", a serious shortcoming of this system occurs in cleaning, especially of the valve arrangement. It is precisely the tubular section of the valve arrangement, which extends almost to the bottom of the baby bottle, that can be cleaned only with difficulty and considerable effort. Machine cleaning appears to be almost ruled out, because it is not ensured that no beverage residues or saliva remain in the tube and [may] lead to problematical contamination. Consequently, only a manual procedure remains for cleaning, in which the interior of the valve arrangement must be carefully cleaned using narrow thin brushes and then must be quickly dried.

SUMMARY OF INVENTION

In view of these serious drawbacks of the known valve arrangement, the underlying task of the present invention is to improve a valve arrangement as known from the prior art so that it is easy and reliable to clean without beverage residues or moisture remaining in it. The manageability known in the valve arrangement of the prior art is also to be kept almost the same.

This task is solved in a first aspect of the present invention by a pressure equalizer (1) comprising

- a hollow element (101) having a cup-like section (1011) and a tube section (1013) that grade seamlessly one into the other, and
- a sealing element (103) having an upper edge (1031) with a first inside diameter (D1) and a center part (1033) with a second inside diameter (D2),
- in which the cup-like section (1011) of the hollow element (101) is accommodated with its upper edge in the second inside diameter (D2) of the center part (1033) of the sealing element (103), characterized by the fact that at least the hollow element (101) is designed [so as] to be disassembled into at least two hollow element parts (101*a*, 101*b*) in its longitudinal axis.

The task is further solved in a second aspect of the present invention by a baby bottle arrangement, comprising

- a bottle-shaped container (3),
- a pressure equalizer (1) according to the invention,
- a screw element (5) and
- a nipple (7*a*) or closure cover (7*b*).

The underlying idea of the invention is to reversibly disassemble the tubular part of the valve arrangement known from the prior art into two parts in order to open the tunnel system of the "Dr. Brown baby bottles" and expose the previously poorly accessible interior. It is possible on this account to open up the hollow element (101) with a few movements in the simplest case in order to reach the interior.

The present invention is described below in detail.

The first aspect of the present invention concerns a pressure equalizer (1), which includes a hollow element (101) and a sealing element (103).

The hollow element (101) has a cup-liked section (1011) and a tube section (1013) that grade seamlessly one into the other. This transition can be made straight and funnel-like to rounded and bell-shaped.

The sealing element (103) has an upper edge (1031) with a first diameter (D1) and a center part (1033) with a second diameter (D2). The first diameter (D1) is especially an outside diameter adjusted to the opening (neck opening) of a baby bottle in order to seal it off precisely. The second diameter (D2) is especially an inside diameter adjusted to the outside diameter of the cup-like section (1011) of the hollow element (101) and that encloses it on the outside.

The cup-like section (1011) of the hollow element (101) is thus accommodated with its upper edge in the second diameter (D2) of the center part (1033) of sealing element (103).

The pressure equalizer (1) according to the invention is characterized by the fact that at least the hollow element (101) is designed [so as] to be disassembled into at least two hollow element parts (101*a*, 101*b*) in its longitudinal axis.

The invention has the major advantage that the pressure equalizer can be opened with a few hand movements and disassembled so that the interior can be simply and effectively cleaned and rapidly dried. The present invention even permits machine cleaning (for example, in a dishwasher), because the exposed interior is readily cleaned and dried.

The two hollow element parts (101*a*, 101*b*) into which the hollow element (101) is disassembled need not be the same size or mirror images of each other. A requirement is that sufficient accessibility of the interior is guaranteed. The hollow element (101), however, is preferably disassembled into two parts (halves) of essentially the same size. Half-elements each of 180° are obtained in particular by halving.

The sealing element (103) preferably consists of a soft and elastic material, for example, silicone. This serves, among other things, a better sealing capability.

In a modification of the pressure equalizer (1) according to the invention, the sealing element (103) is also designed [so as] to be disassembled into at least two sealing element parts (103*a*, 103*b*).

Because of this it is advantageously possible to disassemble the entire pressure equalizer (1) in order to be able to properly clean and dry all parts.

In one embodiment of the pressure equalizer (1) according to the invention, the hollow element (101) can have an articulated connection (1015) that joins the two hollow element parts (101*a*, 101*b*) to each other.

Thus, it is possible to provide a joint function between the two parts on one side, which, on the one hand, can be reached through mechanical connection of the two parts in the form of a joint. On the other hand, the hollow element (101) can consist of two different materials so that a soft and elastic material is provided for the joint connection.

In a modification of this embodiment, connection elements are provided on the opposite side of the joint-like connection (1015). This ensures that, upon closure of the parts of the pressure equalizer (1) according to the invention, it is securely and tightly joined again and satisfies its basic function without error.

The divisibility of the hollow element (101) can be achieved in different ways. For example, the two parts can be fully separated from each other and joined together via a snap connection or click connection.

Another alternative modification of the pressure equalizer (1) according to the invention proposes that the hollow element (101) has at least one fastening element (1019), which reversibly joins the two hollow element parts (101*a*, 101*b*) together. The joint function can thus be dispensed with for different reasons or based on special requirements without deviating from the basic idea of the present invention.

The fastening element (1019) can be chosen in this modification from rings, clamps, snap connections, clip connections, tongue and groove connections, guide elements and/or flexible joints. Specific details are mentioned below and described in preferred embodiments.

Another embodiment concerns the configuration of the sealing element (103), which also includes a transverse tube (1037) in the center part (1033) of the diameter and a central tube (1036) that is connected to the transverse tube (1037) and protrudes from the center part (1033).

The transverse tube (1037) and central tube (1036) serve in the present case for improved ventilation of the pressure equalizer (1) and therefore even simpler pressure equalization.

In order to be able to properly clean the sealing element (103) in the same manner, an embodiment is prescribed in which the sealing element (103) is designed [so as to be] divisible along its diameter. This means that the sealing element (103) is divisible vertically.

As in the case of the hollow element (101), the sealing element (103) can also have a joint-like connection (1035) that connects the two sealing element parts (103*a*, 103*b*) together. Simple opening, cleaning and drying is also an advantage here.

As an alternative, the sealing element (103) can have at least one fastening element that connects the two sealing element parts (103*a*, 103*b*) reversibly to each other. Simple opening, cleaning and drying is also an advantage.

As an alternative embodiment, the sealing element (103) is configured asymmetrically divisible, in which case the transverse tube (1037) and a central tube (1036) are divisible along their longitudinal axis, part of the transverse tube (1037) being connected to part of the central tube (1036). In this way the basic structure of the sealing element (103) remains undivided in its round shape without compromising good cleaning capability.

The previous comments and preferences with respect to the pressure equalizer (1) according to the invention apply accordingly in the baby bottle assembly according to the invention described below. The following comments and preferences with respect to the baby bottle assembly according to the invention also apply accordingly in the pressure equalizer (1) according to the invention.

The second aspect of the present invention pertains to a baby bottle assembly, comprising a bottle-like container (3), the previously described pressure equalizer (1) according to the invention, a screw element (5) and a nipple (7*a*) or closure cover (7*b*).

The advantages of the baby bottle assembly are in principle the same as the advantages of the pressure equalizer (1) according to the invention, namely that the baby bottle assembly in all its parts is simple to disassemble and then properly clean and dry.

In a preferred modification, the baby bottle assembly also includes a coil element (9) having two screw-like coil parts (901, 905) with at least one helical coil part (903) arranged axially in between. The coil element (9) with its helical coil part (903) is then arranged slidable around the tube element (101) with a pressure equalizer (1).

The coil element (9) has the advantage that it can be used in the preparation, mixing and/or processing of the beverage liquid without having to fully disassemble the baby bottle assembly. For example, if powdered milk is included dry in the baby bottle assembly, only the required amount of water need still be added. By shaking the baby bottle assembly, the coil element (9) is moved up and down and thus mixes baby milk in this example with few movements.

In order to further increase the effect and facilitate sliding of the coil element (9), a sleeve (907) can be arranged in another embodiment in the interior of the screw-like coil part (903) in the intermediate space in the tube element (101). This sleeve (907) is designed to be disassembled according to the invention into at least two sleeve parts (907*a*, 907*b*). Here again there is the advantage of simple disassembly with subsequent proper cleaning and drying.

The sleeve (907) can also be used to optimize the pH value of the drinking liquid. Because of the hollow shape a larger surface [area] is available, which communicates chemically with the drinking liquid (especially water) in order to adjust the pH value.

A third aspect of the present invention concerns a drinking element (11), which includes a tubular element. The drinking element (11) is characterized by the fact that at least the tubular element is configured [so as] to be disassembled into at least two half-tube-like element parts (11*a*, 11*b*) in its longitudinal axis.

In this aspect the fundamental idea according to the invention is further developed so that the drinking element (11) according to the invention can be combined, for example, with the baby bottle assembly according to the invention. The drinking element (11) can then supplement or replace the pressure equalizer (1) according to the invention, for example, if older children would like to continue to use their favorite bottle without the parents having to give up the customary good properties for cleaning and drying.

In a modification, a filter element (11*c*) is added to this third aspect on the drinking element (11). This serves to prevent suspended matter from entering the tubular element in order to avoid clogging and deposits. The filter element (11*c*) can also serve to protect the drinking liquid from insects.

BRIEF DESCRIPTION OF FIGURES

Further objectives, features, advantages and application possibilities are apparent from the following description of practical examples that do not restrict the invention with reference to the figures. All described and/or depicted features alone or in any combination then form the object of the invention, also independently of their summary in the claims or their back-referencing. In the figures:

Figure A, Figure B, Figure D and Figure E show parts of the originally claimed device as described below.

FIG. 11 shows a schematic view of a coil element 9 according to an embodiment of the invention with the inserted sleeve 907 and FIG. 12 shows a schematic view of a drinking element 11 according to an embodiment of the invention.

DETAILED DESCRIPTION

Figure 1:
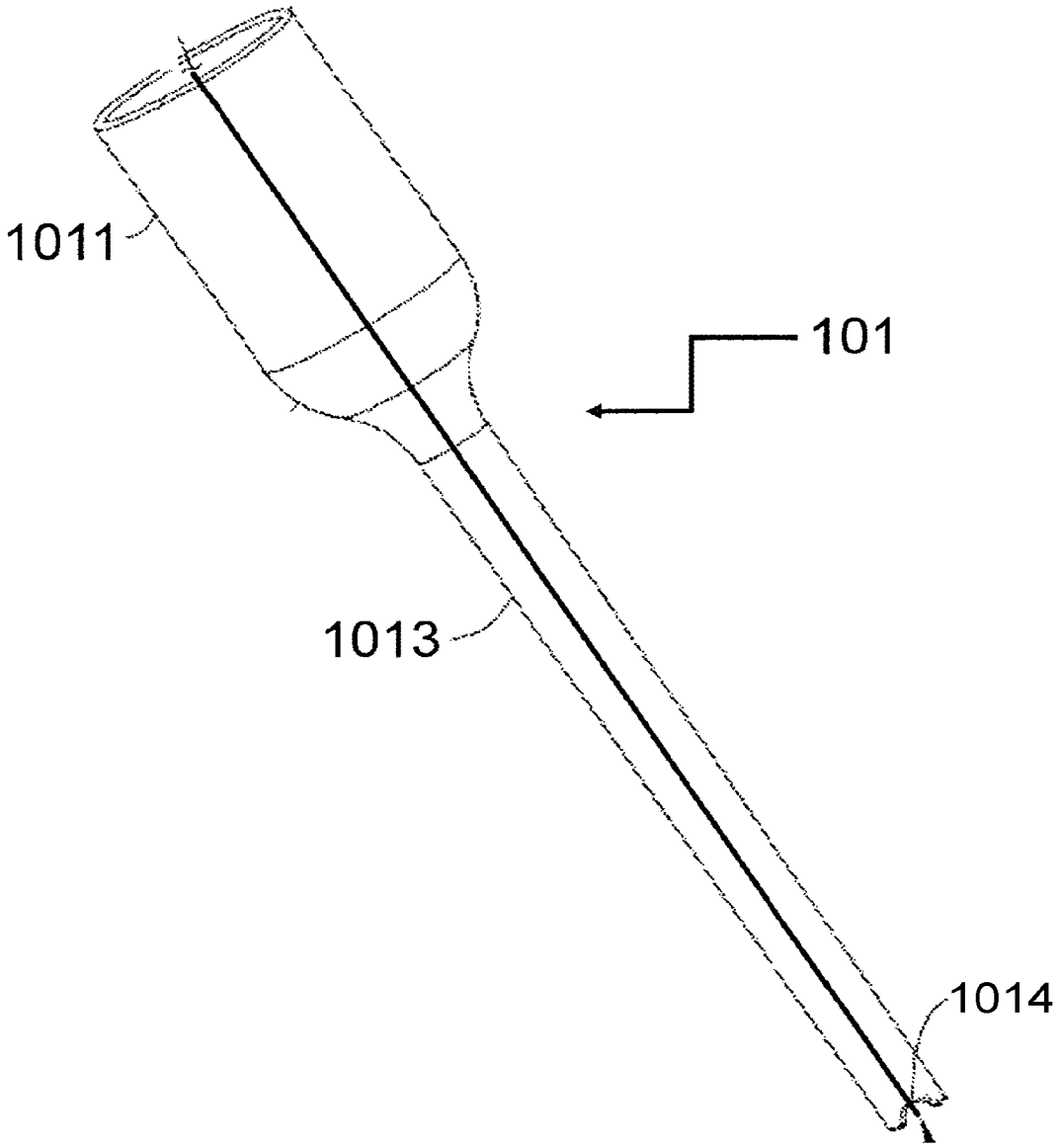
FIG. 1 shows a schematic view of a hollow element 101 according to the invention according to one embodiment of the invention.

The first application forming the basis of priority is referred to below, which defined the following features in conjunction with Figures A, B, D and E:

Easy Clean

There are many practical devices, which, however, are difficult to clean because of added cavities or tunnel devices.

In order to solve this problem but not compromise the function, these devices are preferably divided into two parts but designed to be assembled again.

The cavities are therefore exposed and cleaning is simple.

In Figure A, 1 is a straw and 1.1 is a disk with tunnel passages known from the Dr. Brown baby bottle.

In 3 an ordinary straw.

In 4 an inlay for a coil, known from DE 10 2013 017 310.8.

In Figure B, these devices, hollow element 1, disk 2, straw 3 and inlay 4 are separated lengthwise or crosswise but can be assembled again into their desired embodiment watertight and/or air-impermeable.

The cavities are exposed by the separation and are easy to clean.

D) 1 shows the Dr. Brown anti-colic straw.

2.1 and 2.2 show the two separate halves of the straw. Both can be assembled again into a closed system as in 1.

2.3 and 2.4 are ring elements into which 2.2 is introduced from above in order to guarantee optimal holding. They could also be click elements.

[In] E 1 and 1.1 show the anti-colic disk [used] in Dr. Brown.

In Figure E, a first disk component 2 and a second disk component 3 (corresponding to disk 1 and 1.1) is separated though not in half, but rather into parts having different sizes. The channels, however, are exposed. In first channel component 3.1 and second channel component 3.2, the channel of the Dr. Brown system arranged beneath the disk is also divided lengthwise by a separation and therefore exposed.

3 is inserted onto 2 and with 3.1 into the opening to the channel underneath the disk.

3.2 and 3.1 are assembled again as a closed system.

An additional view of the exposed channel is shown in 2.2.

A pressure equalizer 1 according to the present invention is shown in FIG. 1 in the closed state. The hollow element 101 then has a cup-like section 1011 in the upper area that is connected to the sealing element 103. The sealing element 103 positions the pressure equalizer in the bottle neck (cf. FIG. 9) and simultaneously represents a seal relative to the screw element 5 with the nipple 7*a*. On the opposite side the cup-like section 1011 grades into a tube section 1013, which is dimensioned such that it extends almost to the bottom of the bottle-like container 3.

One embodiment proposes that the tube section 1013 ends 1 mm to 5 mm before the bottle bottom. In an alternative embodiment, the tube section 1013 can be closed off with the bottle bottom but at the same time have recesses 1014 on the lower edge, such as small semicircles, so that air exchange is guaranteed when the bottle is used.

The hollow element 101 and the sealing element 103 each consist of a food-compatible material permitted for babies and small children, especially polypropylene (PP) for the tube section and silicone for the sealing element.

Figure 2:
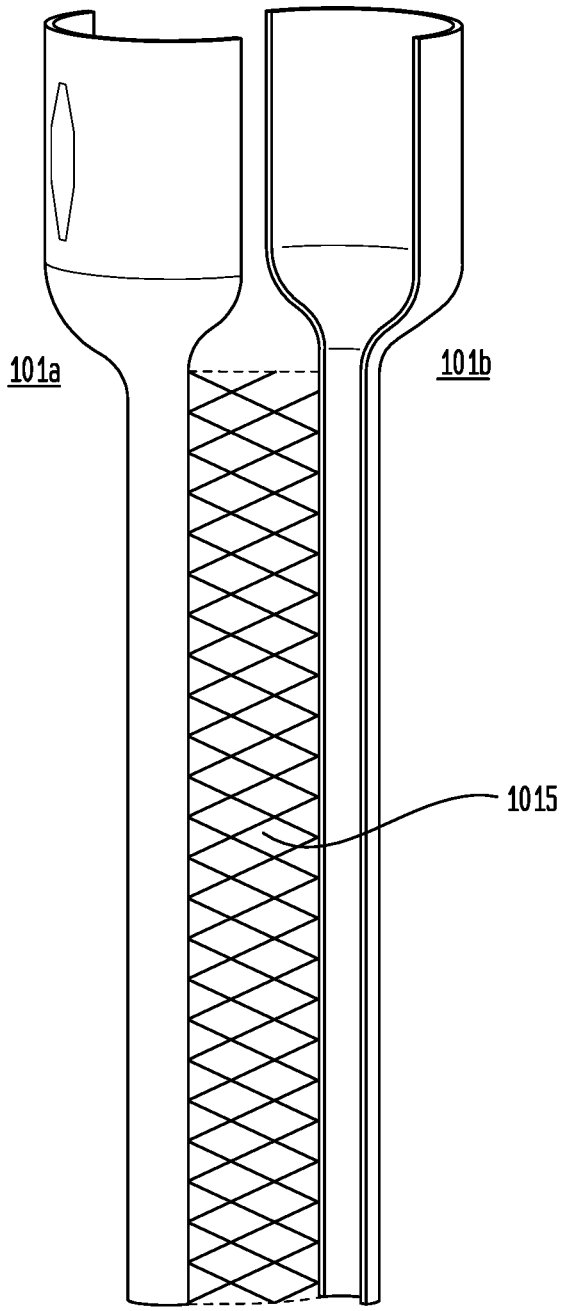
FIG. 2 shows a schematic view of a disassembled hollow element 101 according to the invention according to an embodiment of the invention with the joint-like connection 1015.

An embodiment in which the hollow element 101 has a joint-like connection 1015 that connects the two hollow element parts 101*a*, 101*b* to each other is shown in FIG. 2. Essentially one part is therefore obtained that can be opened for cleaning and closed again for functional use. Two different materials can be preferably used here, for example, silicone in the joint-like connection 1015, because it is very soft and elastic, and a plastic-like polypropylene (PP) in the two hollow element parts 101*a*, 101*b*.

There is also the possibility of molding a soft material on locations at which the two hollow element parts 101*a*, 101*b* are reassembled. This ensures the hollow element 101 is closed again [so as to be] airtight and watertight.

Another variant according to the invention, in order to join the two hollow element parts 101*a* and 101*b* in sealed fashion, can be achieved by a compression or rail matching a recess (tongue and groove arrangement).

Figure 3:
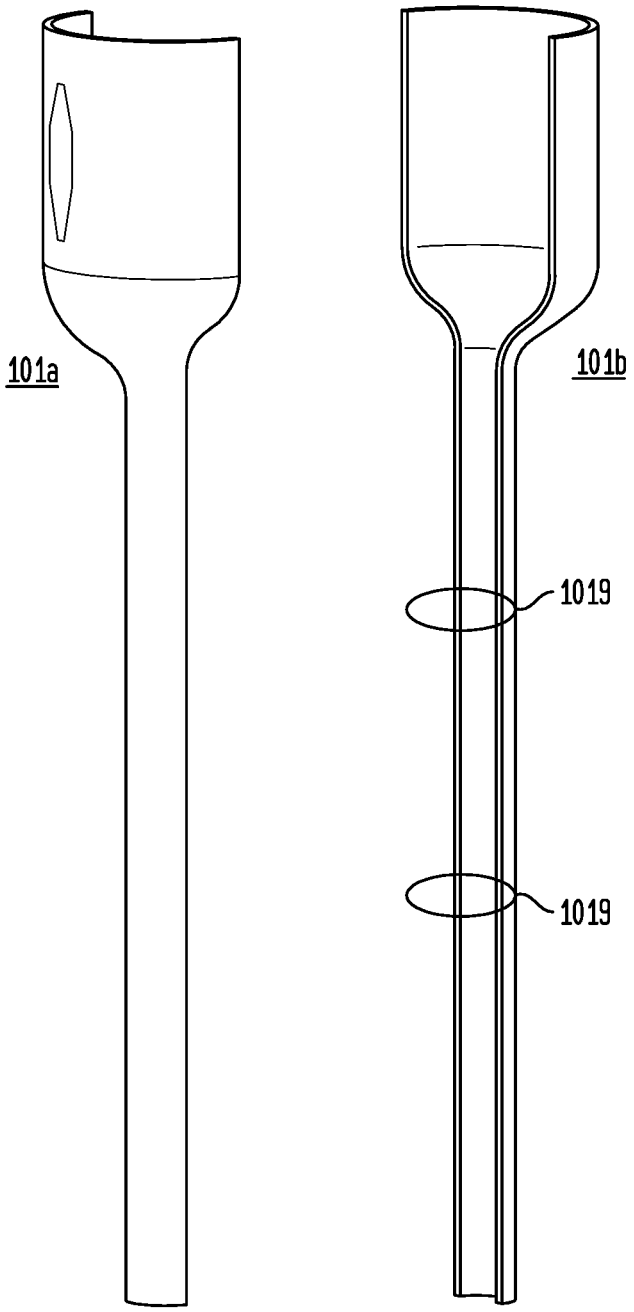
FIG. 3 shows a schematic view of a disassembled hollow element 101 according to the invention according to an embodiment of the invention with fastening elements 1019.
Figure 4:
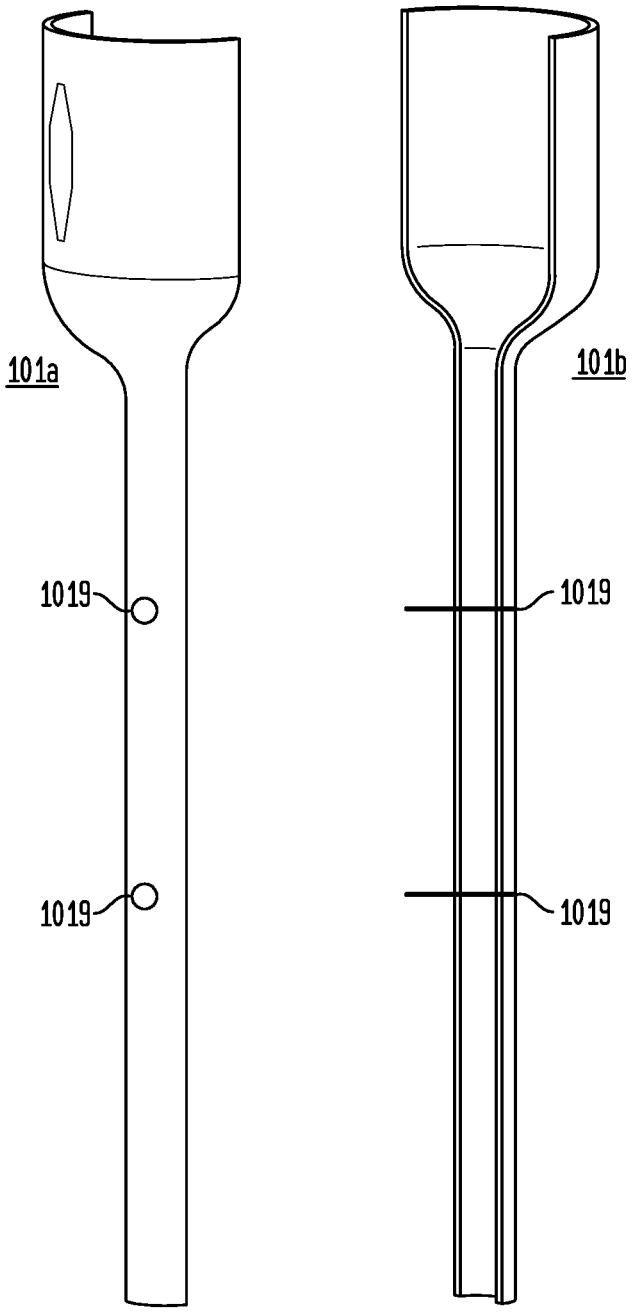
FIG. 4 shows a schematic view of a disassembled hollow element 101 according to the invention according to another embodiment of the invention with fastening elements 1019.

FIGS. 3 and 4 schematically depict variants in which the two hollow element parts 101*a*, 101*b* are separated from each other and joined again by fastening elements 1019.

In FIG. 3 rings are shown, for example, as fastening elements 1019, which are positioned on one of the two hollow element parts 101*a*, 101*b*. These rings serve as a guide, over which the two hollow element parts 101*a*, 101*b* can now be pushed back into each other from above. The system of rings is then made matching such that the pressure at the interfaces forces the two hollow element parts 101*a*, 101*b* against each other so that sealing is obtained for a closed system. A molded-on lip made of a soft material, preferably silicone, can optimize tightness at the cutting edges.

Click elements are shown in FIG. 4 as fastening elements 1019, which are used for firm snapping in.

Figure 5:
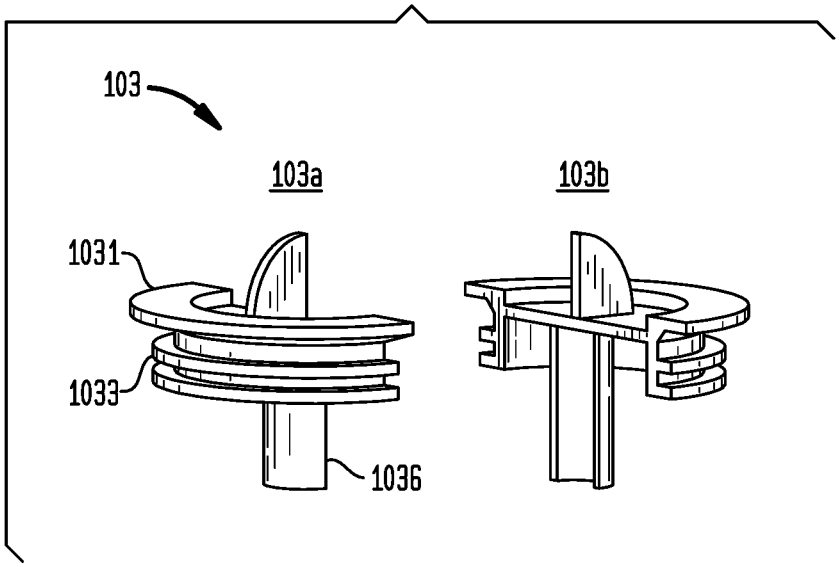
FIG. 5 shows a schematic view of a disassembled sealing element 103 according to the invention according to an embodiment of the invention.
Figure 6:
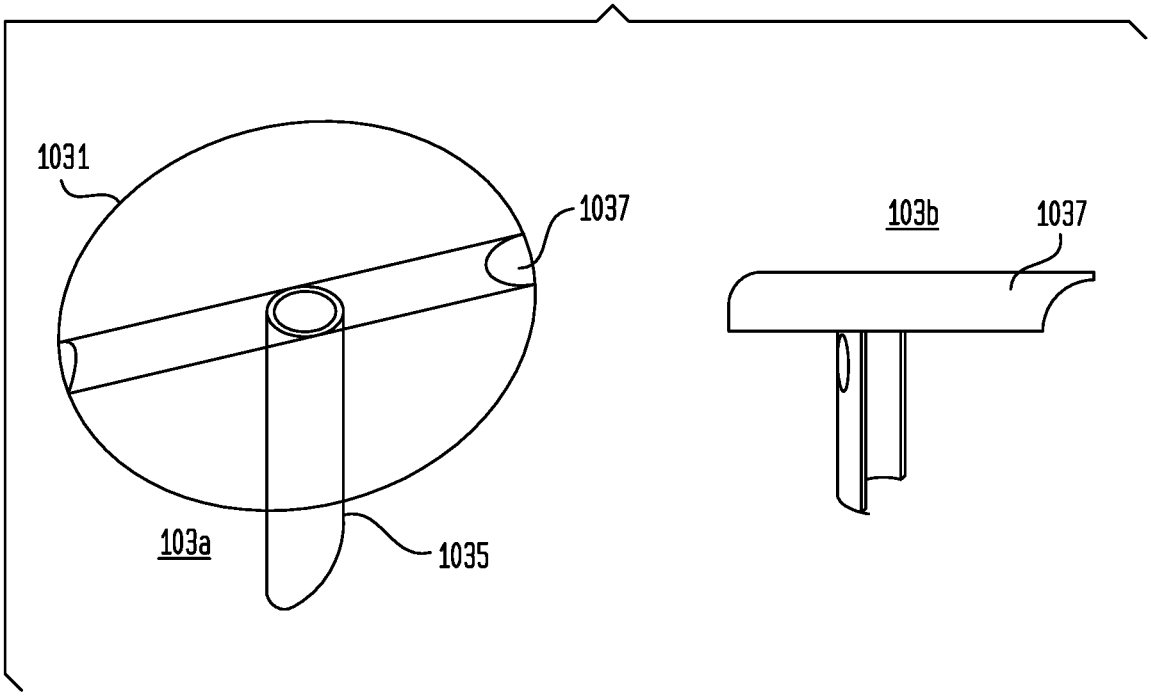
FIG. 6 shows a schematic view of a disassembled sealing element 103 according to the invention according to another embodiment of the invention.

FIGS. 5 and 6 show divided sealing elements 103 in different embodiments.

A click system is shown in FIG. 5, in which the two sealing element parts 103*a*, 103*b* are inserted, for example, using small pins on the cutting edge of one part into the corresponding matching opening on the cutting edge of the other part such that the two sealing element parts (103*a*, 103*b*) can be snapped into each other and unsnapped. Here again sealing can preferably be improved by molding on a soft material like silicone. The sealing element 103 depicted in FIG. 5 is preferably divided vertically in the center so that the tunnel is exposed and can be easily cleaned.

The sealing element 103 depicted in FIG. 6 is divided asymmetrically, as already described above. A smaller part 103*b* then covers half of the top of the tunnel system and the tunnel system is simultaneously exposed in the larger part 103*a*. The smaller part 103*b* is inserted from the top into the lower larger part 103*a* to restore the tunnel system.

The sealing element 103 seals off the cup-like section 1011 and ensures open air exchange by means of the tunnel system. The tunnel system can run horizontally in the center through the sealing element 103 and preferably lead the air into the interior of the pressure equalizer 1 via an additional directly connected vertical tunnel.

Figure 7:
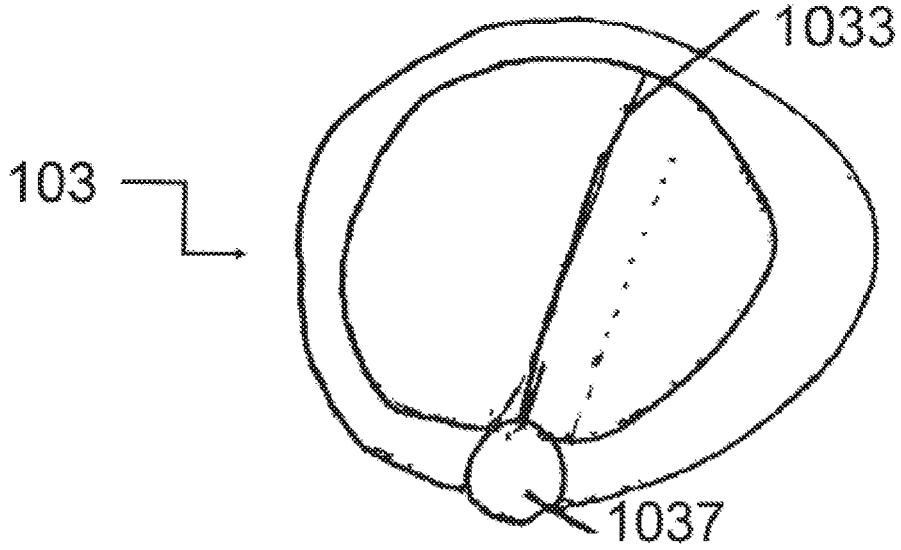
FIG. 7 shows a schematic view of a sealing element 103 capable of being disassembled according to another embodiment of the invention in the assembled state.
Figure 8:
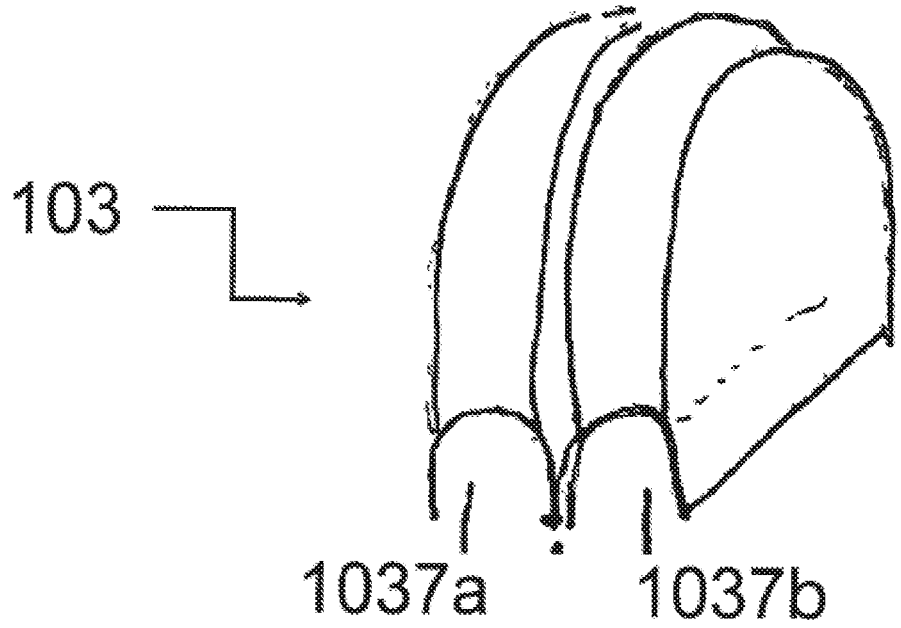
FIG. 8 shows a schematic view of the sealing element 103 depicted in FIG. 7 according to an embodiment of the invention in the disassembled state.

Another embodiment of the sealing element 103 is shown in FIGS. 7 and 8, in which two essentially mirror-image sealing element parts 103*a*, 103*b* are connected via a joint-like connection and can be simply opened for cleaning.

Figure 9:
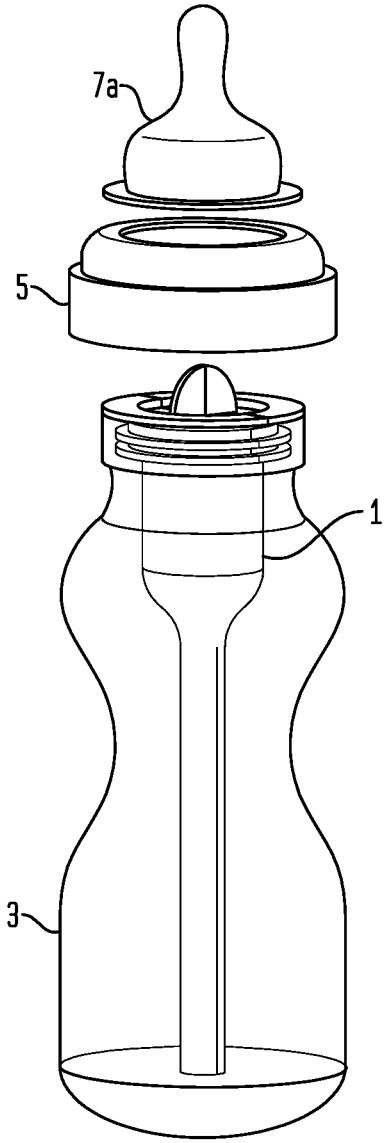
FIG. 9 shows a schematic view of a baby bottle assembly according to an embodiment of the invention.

FIG. 9 shows a baby bottle assembly according to the invention with a bottle-like container 3, a pressure equalizer 1 arranged in it, a screw element 5 and a nipple 7*a*. As an alternative to the nipple 7*a* a closure cover 7*b* can be provided. An ordinary cap that protects the nipple 7*a* is not shown.

Figure 10:
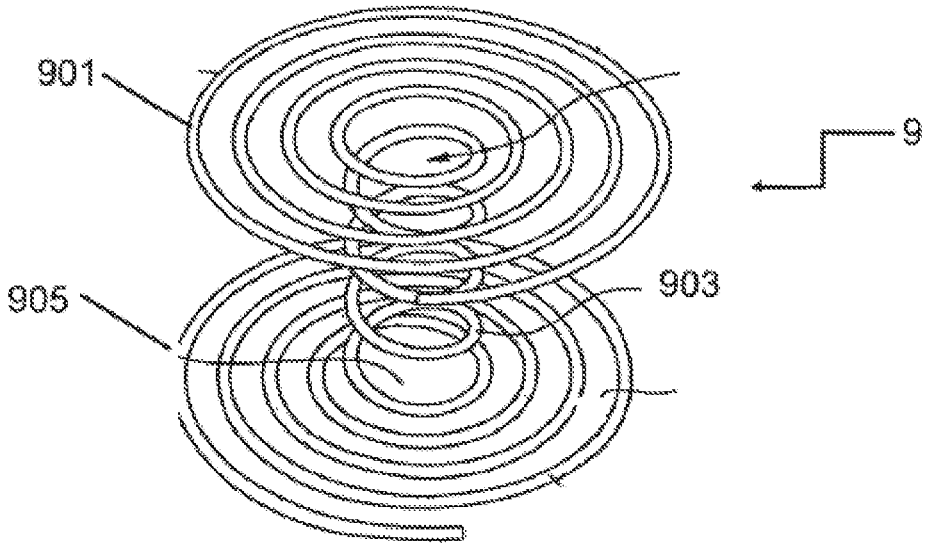
FIG. 10 shows a schematic view of a coil element 9 according to an embodiment of the invention.
Figure 11:
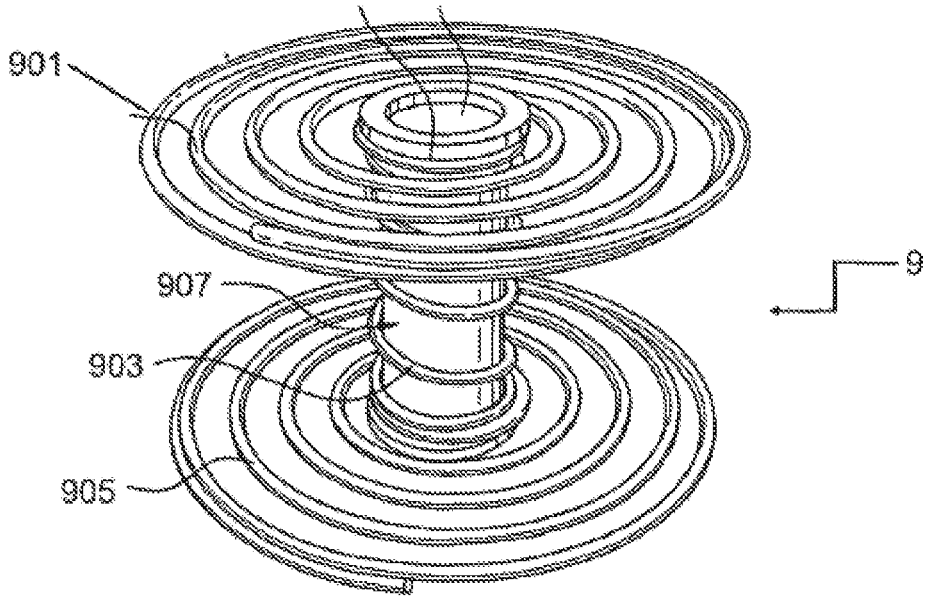

The coil element 9 with the two screw-like coil parts 901, 905 and the helical coil part 903 arranged axially in between is shown in FIG. 10, whereas in FIG. 11 a sleeve 907 is also added, which is arranged in the interior of the helical coil part 903 in the intermediate space of the tube element 101. The sleeve 907 is inserted [so as to be] matching and can also be disassembled into two sleeve parts 907*a*, 907*b* for cleaning.

Finally, a drinking element 11 is shown in FIG. 12, which is reminiscent in its basic shape of a straw, the depiction showing the form opened for cleaning. The drinking element 11 is preferably made by [means of] injection molding.

The ventilation device in its preferred embodiment is laid out in dimensions for use with the "Dr. Brown baby bottles". In principle, however, the present invention can also be designed for any other dimension and for any bottle system available on the market, for example, for use with bottles from the NUK company or the MAM company.

Because most manufacturers offer different bottle sizes, in another embodiment at least the tube element is offered in different lengths so that reliable ventilation is ensured with any of the employed bottle sizes.

The invention claimed is:

1. A Pressure equalizer (1) comprising a hollow element (101) having a cup section (1011) and a tube section (1013) that grade seamlessly one into the other, and a sealing element (103) having an upper edge (1031) with a first diameter and a center part (1033) with a second diameter, the cup section (1011) of the hollow element (101) being accommodated with its upper edge in the second diameter of the center part (1033) of the sealing element (103), characterized in that at least the hollow element (101) is designed so as to be disassembled into at least two hollow element parts (101*a*, 101*b*) along its longitudinal axis;

wherein the sealing element (103) comprises a transverse tube (1037) and a central tube (1036) connected at a right angle to said transverse tube (1037) at the center part (1033); and wherein the sealing element (103) is configured to disassemble into two sealing element parts (103*a*, 103*b*) with partition lines formed lengthwise along a longitudinal axis of the transverse tube (1037) or a longitudinal axis of the central tube (1036).

2. The Pressure equalizer (1) according to claim 1, in which the hollow element (101) has an articulated connection (1015) that connects the two hollow element parts (101*a*, 101*b*) to each other.

3. The Pressure equalizer (1) according to claim 2, in which connection elements are provided on an opposite side of the articulated connection (1015).

4. The Pressure equalizer (1) according to claim 1, in which the hollow element (101) has at least one fastening element (1019) that reversibly connects the two hollow element parts (101*a*, 101*b*) to each other.

5. The Pressure equalizer (1) according to claim 4, in which the fastening element (1019) is selected from the group consisting of rings, clamps, snap connections, clip connections, tongue and groove connections, guide elements, expansion joints, and a combination thereof.

6. The Pressure equalizer (1) according to claim 1, wherein the upper edge (1031) and the center part (1033) are separable into two components along the longitudinal axis of the central tube (1036).

7. The Pressure equalizer (1) according to claim 1, wherein the sealing element (103) is designed so as to be divisible along both the longitudinal axis of the transverse tube (1037) and the longitudinal axis of the central tube (1036).

8. The Pressure equalizer (1) according to claim 1, wherein the sealing element (103) has an articulated connection (1035) that connects the two sealing element parts (103*a*, 103*b*) to each other.

9. The Pressure equalizer (100) according to claim 1, wherein the sealing element (103) is designed so as to be asymmetrically divisible, with both the transverse tube (1037) and the central tube (1036) being divisible along their longitudinal axis, in which part of the transverse tube (1037) is connected to a part of the central tube (1036).

10. A Baby bottle assembly, comprising:

a bottle (3), the pressure equalizer (1) according to claim 1, a screw element (5), and a nipple (7*a*) or closure cover.

11. The Baby bottle assembly according to claim 10, further comprising a coil element (9) having two spiral coil parts (901, 905) with at least one helical coil part (903) arranged axially in between, the coil element (9) being arranged with its helical coil part (903) slidable around the hollow element (101) of the pressure equalizer (1).

12. The Baby bottle assembly according to claim 11, further comprising a sleeve (907) that can be arranged in an interior of the helical coil part (903) in an intermediate space of the hollow element (101), the sleeve (907) being designed so as to be disassembled into at least two sleeve parts.

* * * * *